United States Patent [19]

Olivier et al.

[11] Patent Number: 4,986,787

[45] Date of Patent: Jan. 22, 1991

[54] METHOD OF MAKING AN INTEGRATED COMPONENT OF THE COLD CATHODE TYPE

[75] Inventors: Jean Olivier, Les Ulis; Didier Pribat, Paris, both of France

[73] Assignee: Thomson-CSF, Puteaux, France

[21] Appl. No.: 410,850

[22] Filed: Sep. 22, 1989

[30] Foreign Application Priority Data

Sep. 23, 1988 [FR] France ..... 88 12470

[51] Int. Cl.[5] ..... H01J 40/12; H01J 19/24

[52] U.S. Cl. ..... 445/24; 427/255.5; 437/80; 437/64; 148/DIG. 143

[58] Field of Search ..... 445/24, 25; 437/49, 437/80, 90, 904, 948; 313/495; 427/255.5; 148/DIG. 26, DIG. 143

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 313/309 X |
| 3,921,022 | 11/1875 | Levine . | |
| 4,370,797 | 2/1983 | van Gorkom et al. | 313/303 X |
| 4,554,564 | 11/1985 | van Gorkom et al. | 313/422 X |
| 4,683,399 | 7/1987 | Soclof | 313/495 X |
| 4,721,885 | 1/1988 | Brodie | 313/309 X |

FOREIGN PATENT DOCUMENTS

| | | |
|---|---|---|
| 0278405 | 8/1988 | European Pat. Off. . |
| 3224218 | 1/1983 | Fed. Rep. of Germany . |
| 63-187535 | 8/1988 | Japan . |

OTHER PUBLICATIONS

Patent Abstracts of Japan, vol. 12, No. 215 (E-623)(3062), Jun. 18, 1988; & JP-A-63 10 428, 01-1-8-88, A. Shimizu, "Cold Cathode Device".

*Primary Examiner*—Kenneth J. Ramsey
*Attorney, Agent, or Firm*—Oblon, Spivak, McClelland, Maier & Neustadt

[57] ABSTRACT

The disclosed microcomponent has a surface oxidated type of Si substrate, at least one cathode with caesiated surface made of n type monocrystalline Si being formed on this substrate. It is surrounded by monocrystalline p tyep Si. A layer of $SiO_2$, formed on the p type Si, has an aperture facing the cathode. This aperture is self-sealed by the anode material.

25 Claims, 3 Drawing Sheets

FIG. 1
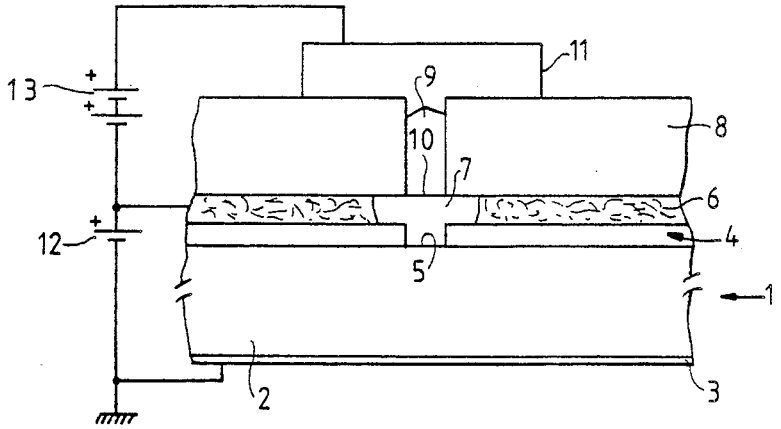
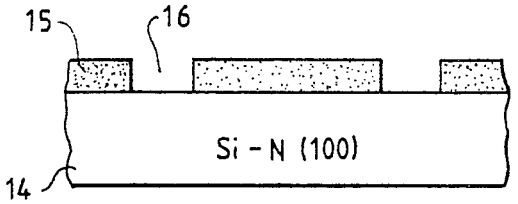
FIG. 2
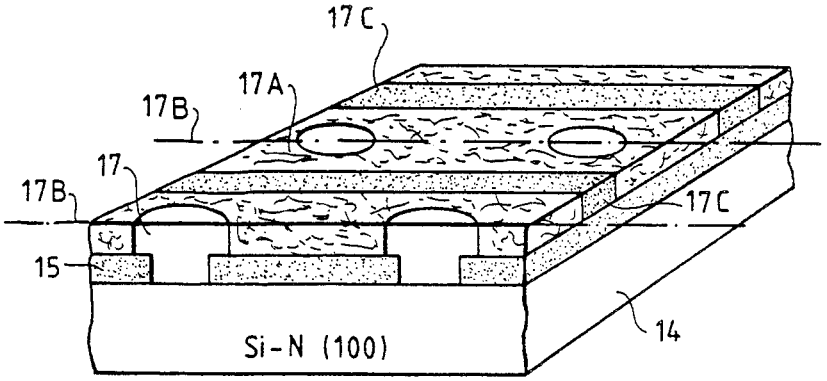
FIG. 3a

METHOD OF MAKING AN INTEGRATED COMPONENT OF THE COLD CATHODE TYPE

BACKGROUND OF THE INVENTION

1. Field of the Invention

The present invention pertains to a component such as a diode, a triode or a flat and integrated cathodoluminescent display device, and to a method for the fabrication of a device such as this.

2. Description of the Prior Art

The recent literature includes a number of publications relating to cathodoluminescent display devices. Apart from the standard electron gun with its system of excitation of a luminophor in a "television tube" type of vacuum tube, there are new approaches now emerging. Thus, one current trend that can be seen consists in the use of matrix arrangements of microguns, the working of which is multiplexed by means of an adapted electronic circuitry. An embodiment such as this is given in an article by R. Meyer and coll., "Microtips Fluorescent Display", presented at the "Japan Display 1986" conference. The microguns are formed by molybdenum tips, and the electrons are extracted by field effect between the tip and a grid located at the top of the tip. An anode, made of a luminophor material, is positioned at a distance of about 100 μm from the plane of the gate.

It is possible to envisage a structure that is similar but has its microtips made by using no longer a matrix of field effect microtips but a matrix of cold microcathodes made on semiconductor material (Si for example). This type of cathode uses a semiconducting surface treated so as to have a negative electron affinity. As for Si, the surface treatment used to obtain this property consists in the successive adsorption on a surface (100), reconstructed by heat treatment, of a caesium monolayer and an oxygen monolayer. More details on this caesiation technique will be found in the articles by B. Goldstein (Surf. Sci. 47, 1975, p. 143) and J.D. Levine (Surf. Sci 34, 1973, p. 90).

Under the above-described conditions of caesiation of p type Si, and because of:

(a) the considerable reduction i the level of the vacuum;

(b) the curvature of the conduction bands on the surface, the electrons located at the minimum level of the conduction band, in the volume of the material, have an energy level which is greater than that of the level of the vacuum the so-called situation of "negative" electron affinity is obtained.

If the layer of p type silicon thus treated is placed on an n type substrate, and if the junction thus obtained is forward biased, there is an injection of electrons that are emitted in the vacuum after going through the p type layer.

The making of a cold cathode such as this has been described by E.S. Kohn (IEEE Transactions on Electron Devices, ED-20, No. 3, 1973, p. 321).

E. S. Kohn has used this type of cathode to reproduce, on a screen supporting a luminiphor and placed at 0.5 mm from the plane of the cathode, characters etched in silicon and treated, according to the above description, to have negative electron affinity.

The drawback of all these devices (devices with emission by field effect, or devices using silicon cold cathodes) is that they can work only under ultrahigh vacuum conditions. This is particularly true for caesiated silicon surfaces, where the least adsorption of foreign atoms is liable to raise the energy state of the level of the vacuum, thus seriously affecting the emissive properties of the surface.

SUMMARY OF THE INVENTION

An object of the present invention is a component such as a diode or a display device of the cold cathode type, made of a p type semiconductor treated so as to have a negative affinity, a component that does not necessitate the creation of a high vacuum in a relatively large volume, and can be fabricated automatically in batches and at a reasonable cost price.

Another object of the present invention is a method for the fabrication of such components.

The component according to the invention has at least one microvolume enclosing a microcathode and self-sealed under vacuum by the anode material.

According to the invention, there is proposed a method for fabricating a component of the cold cathode type formed on a substrate made of a semiconducting material capable of being brought to a state of negative electron affinity, said method consisting, when said semiconducting material is silicon, in:

oxidizing one face of a substrate with n type silicon, said substrate being at least partially monocrystalline;

etching at least one aperture in the silica of this face;

depositing p type silicon on the silica and on the bared parts of the substrate so as to have a surface that is really plane after deposition, said silicon being monocrystalline in the apertures and polycrystalline on the silica;

depositing a layer of dielectric material;

etching, in this latter layer, apertures that are substantially in the axis of the above-mentioned apertures until the layer of p type silicon is reached;

performing an in situ cleaning of the bared surfaces of the p type silicon layer;

doing a treatment that brings the cleaned surfaces to a state of negative electron affinity;

evaporating a layer of anode material under high vacuum and at grazing incidence, the substrate undergoing a rotational motion on an axis perpendicular to the surface of this substrate, until the sealing of the microcavity thus made.

BRIEF DESCRIPTION OF THE DRAWINGS

The present invention will be better understood from the following detailed description of two modes of fabrication, taken as non-restrictive examples and illustrated by the appended drawings, wherein:

FIG. 1 is a schematic, sectional view of a microcomponent according to the invention;

FIGS. 2, 3A and 4 to 8 are schematic, sectional views illustrating the different successive steps of a first fabrication mode of the invention;

DETAILED DESCRIPTION OF THE INVENTION

Figure 3B:
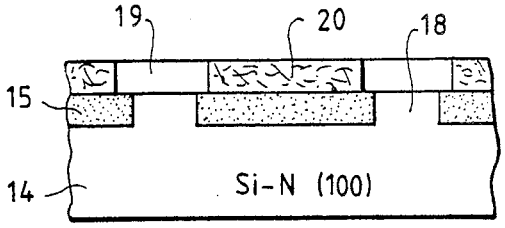
FIGS. 3B and 9 are schematic, sectional views showing particular steps of a second fabrication mode of the invention.

The invention is described below with reference to the making of a luminous microtip and display panels having a very large number of luminous microtips such as this, but it is clearly not restricted to a component such as this, and can be applied to the making of other cold cathode components such as diodes or triodes (the term "triodes" being understood to mean "components with three electrodes").

FIG. 1 shows a luminous micropoint 1 according to the invention. This component 1 has a substrate 2 which, in the present case, is made of n type silicon, the lower face of which has a coating 3 made of a material which is a good electrical conductor, enabling the substrate 2, forming one of the electrodes of the component 1, to be connected to the outgoing conductor. According to another embodiment, not described in detail herein, the substrate is made of AsGa. Those skilled in the art could easily adapt the steps of the method described below to this material AsGa, by referring to the French Pat. application No. 88 04437.

The upper face of the substrate 2 is coated with a layer 4 of silica ($SiO_2$) or any other dielectric ($Si_3N_4$, $Al_2O_3$...), with the exception of an aperture 5. The substrate 2 should be monocrystalline, at least at the level of the aperture 5. The layer 4 and the surface of the substrate 2 forming the aperture 5 are coated with a layer 6 of p type silicon. In the zone of the aperture 5, the layer 6 has a monocrystalline structure in a volume 7. This volume 7 is shaped somewhat like a micro-mushroom, the stalk of which would correspond to the aperture 5. The rest of the layer 6, deposited on the layer 4 of dielectric, has a polycrystalline structure. The reason for this difference in the structure of the layer 6 will appear below in the description of the method of fabrication of the luminous micropoint.

The layer 6 is coated with a layer 8 of silica or another dielectric, except for an aperture 9 which is coaxial to the aperture 5 and has the same diameter as the latter. The surface 10 of the layer 6, which is not covered by the layer 8, is treated so as to have negative electron affinity, for example by caesiation. A layer 11 of anode material extensively covers the aperture 9 in sealing it. A high vacuum, of the order of $10^{-10}$Torr) prevails in the microvolume determined by the aperture 9, sealed at one end by the layer 6 and to the other end by the layer 11. Should the component be a luminous micropoint, as specified above, the layer 11 is made of a luminophor material, such as zinc oxide. Should the component be a diode or a triode, the layer 11 is simply an electrically conductive material. The layers 3, 6 and 11 are connected to suitably biased voltage sources 12, 13.

The component 1 can work in ambient atmosphere since the vacuum is maintained in the microvolume through a sealing done by the anode material.

We shall now describe a method for making a component according to the invention.

Step 1 (FIG. 2)

This step starts with a wafer 14 of standard, n type semiconductor material. Preferably, this material is made, for example, of silicon (100) or (110) or (111), for this material exists in the form of large-sized substrates. The surface of the wafer 14 is oxidized until an insulating layer 15 of silica is obtained. This layer 15 has, for example, a thickness of about 1 000 to 1 500 Å. Apertures 16 are etched in the silica by means of an appropriate lithographic technique, for example an optical or electronic technique. Seen from the top, the aperture 16 may have any shape: circular, square, rectangular, oblong etc. The dimensions of this shape, seen from the top, are of the order of one micrometer. If the shape seen from the top is circular, its diameter will be of the order of one micrometer.

In the case of cathodoluminescent components, one or more components such as this, placed side by side, are used to define a light pixel.

Step 2 (FIGS 3A and 3B)

The surfaces of the wafer 14, previously bared by the creation of the apertures 16 in the silica, are coated with p type monocrystaline silicon (crystalline plane 100) epitaxially grown by chemical vapor deposition. It is important for the surface of the silicon deposit to be really plane. It is this surface that will be brought to the condition of negative electron affinity during a subsequent step (step 5).

To make this silicon deposit, the invention provides for two fabrication methods characterized by different conditions of deposition.

The first method, illustrated by FIG. 3A, consists in a cracking of the molecules of the mixture $SiH_4+H_2+B_2H_6$ at a temperature of about 900 to 1060 degrees C (using the so-called APCVD or atmospheric pressure chemical vapor deposition method). The gas $B_2H_6$ can be used to obtain the p type doping of the silicon deposit. The growth of the deposit 17 on the substrate 14 left free by the apertures is monocrystalline, with the same orientation (plane 100) as the substrate 14, and hence makes the deposit 17 capable of being brought to the state of negative electron affinity. By contrast, the silicon deposit 17A is polycrystalline on the silica.

Since the speed of growth of the deposit in a direction that is perpendicular to the surface plane of the substrate is greaqter on the monocrystalline zones 16 than on the silica 15, after a certain time, which depends on the thickness of the starting silica layer 15, a deposit is achieved with a thickness that is practically uniform throughout the wafer. The silicon deposit (17+17A) may then be said to be "planarized".

When, as shown in FIG. 3A, several identical or similar components are formed on one and the same substrate, for example with a view to making a matrix network, it is possible to give the deposits (17+17A) shapes of strips, with the deposits 17 being aligned parallel to the axis of these strips and being, preferably, evenly spaced out. These strips may be obtained by etching the layer 17A up to the layer 15. This etching forms trenches in the layer 17A. These trenches are parallel to the axes 17B, with which the columns of deposits 17 are formed, and are equidistant, each time, from the two consecutive axes of columns of deposits 17. These trenches are then filled with silica 17C, by using a standard deposition method of the LTO (low temperature oxide) or HTO (high temperature oxide) type in association with a lift-off technique enabling the easy removal of the silica deposit from the regions 17 and 17A. Another method consists in depositing a uniform layer of silicon nitride ($Si_3N_4$), etching strips such as 17C in this layer and then doing a localized oxidation of the underlying silicon. The silicon nitride is then removed by selective chemical attack (using a LOCOS type method).

The second method of fabrication, illustrated in FIG. 3B, is based on the technique of selective epitaxy, and is done at atmospheric pressure (by APCVD) or else by reduced pressure chemical vapor deposition (RPCVD) at a temperature ranging between 900 and 1060 degrees C approximately. It makes use of a gas mixture $SiH_4+HCl+H_2+B_2H_6$ enabling the work to be done close to thermodynamic equilibrium.

The selectivity of the deposition is governed by a mechanism of selective nucleation through which the growth of the silicon is possible on surfaces with a low nucleation barrier, such as silicon (100) and is not possible on a foreign surface such as silica. For more details, cf. the article by J.O. BORLAND and C.I. DROWLEY in "Solid State Technology", August 1985, p. 141, as well as the article by L. KARAPIPERIS and coll. in "Proceedings of the 18th Conference on Solid State Devices and Materials", Tokyo, 1986, p. 713.

The epitaxy is done on the substrate 14, coated with the layer 15 and having the apertures 16, as shown in FIG. 2. When the apertures 16 are filled with monocrystalline p type silicon 18, the inlet of HCl gas is cut off. This eliminates the selectivity and enables the deposition of silicon (which, however, is polycrystalline) also on the layer 15. The deposit is then uniform in thickness throughout the area of the wafer (surfaces 18 and 15). The total thickness of the deposit is of the order of one micrometer. The deposit 19 on the surfaces 18 is monocrystalline p type silicon, and goes slightly over these surfaces, while the deposit 20 on the remaining surfaces is polycrystalline p type silicon.

According to one variant, not shown, of the first and second modes of fabrication, the thickness of the layers 17, 18, 19 of monocrystalline p silicon is reduced to the minimum. Components with faster operation are then obtained owing to the fact that their response time is chiefly a function of the transfer time of the minority carriers in the p type silicon zone (layers 17, 18 and 19).

The following is the second mode of fabrication of this variant. The apertures made in the silica 15 are selectively filled with n type monocrystalline silicon, without depositing any on the silica. Hence, conditions of selective epitaxy are brought about, and gas fluxes comprising, for example, $SiH_4+HCl+H_2+PH_3$ are obtained. The component $PH_3$ is used for the n type doping. Then the deposition of p type silicon is done, non-selectively this time, this silicon being monocrystalline on the n type silicon layer and polycrystalline on the silica layer, in using a gas mixture $SiH_4+B_2H_6$.

The p silicon layer thus obtained may have a thickness of between 1 000 and 5 000 Å approximately. This method further makes it possible, by localized oxidation (for example in using the method known as "LOCOS"), to create p type silicon bands (forming columns of a matrix display device similar to the one shown in FIG. 9) isolated from one another.

Figure 4:
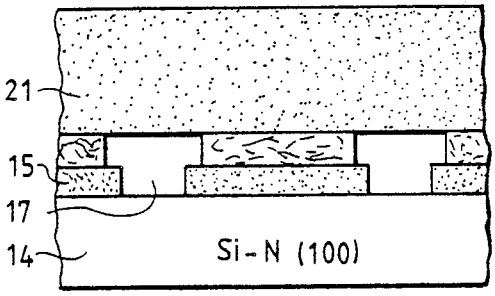

Step 3 (FIG. 4)

A dielectric layer 21 of silica ($SiO_2$) for example (this is not restrictive) is deposited on either of the structures of FIGS. 3A and 3B. This dielectric layer 21 has a thickness of 2 to 10 micrometers. To simplify the drawings, FIG. 4 shows the structure of FIG. 3A with the substrate 14 and the layers 15, 17 and 17A, but it is clear that the structure of FIG. 3B could also have been shown with the substrate 14 and the layers 15, 18, 19 and 20. FIGS. 5 to 8, described below, also include the structure of FIG. 3A. Only FIG. 9 includes the structure of FIG. 3B. The silica layer 21 is achieved preferably by a high temperature operation (HTO), for example by pyrolysis of a gaseous mixture $SiH_2Cl_2+N_2O$ at a temperature of less than 250 degrees C and advantageously between about 850 and 900 degrees C. The silica layer thus obtained has sound mechanical and electrical properties.

Instead of silica, the layer 21 can be made of dielectric materials such as $Si_3N_4$, $Al_2O_3$, $ZrO_2$ etc., by using appropriate deposition techniques.

Figure 5:
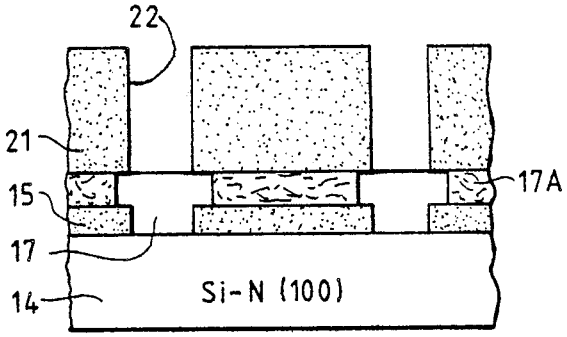

Step 4 (FIG. 5)

Reactive ion etching (RIE) is used to etch coaxial apertures 22 to the layers 17 or 19 in the dielectric layer 21. It will be noted that, because of the overhanging of the monocrystalline "head" of the "mushroom 17" with respect to its "stalk", or that of the layer 19 with respect to the layer 18, the centering of the apertures 22, made in the layer 21, with respect to the monocrystalline contacts ("head" of the "mushroom" or layer 19) is not very significant.

Figure 6:
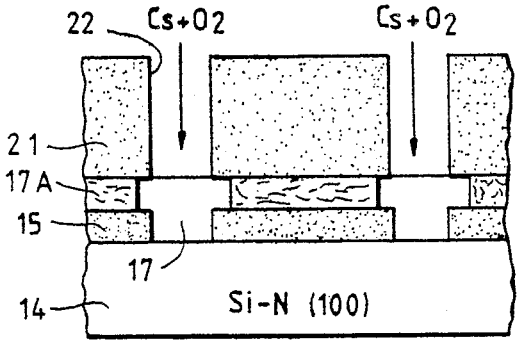

Step 5 (FIG. 6)

A prior in situ cleaning is done of the surface of the p type silicon contacts, bared during the etching of the apertures 22 (step 4). This cleaning essentially consists in the removal of the native silicon oxide on this surface of the contacts, by heating the wafer to about 1000 degrees C in a chamber under ultrahigh vacuum (about $10^{-10}$Torr) wherein said surface of the contacts is then activated by caesiation. The technique of caesiation may be one of the techniques known per se from the articles cited in the introduction.

Figure 7:
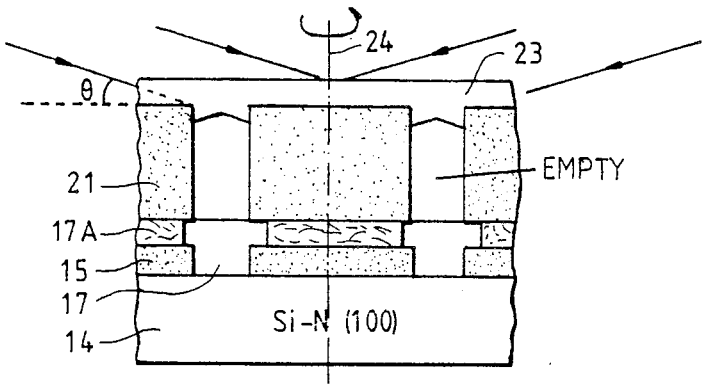

Step 6 (FIG. 7)

In the same chamber under ultrahigh vacuum, a layer 23 of luminophor material, for example ZnO, is evaporated at grazing incidence (angle of incidence $\theta$ smaller than 15 degrees), with the substrate 14 undergoing a rotational motion on a axis 24, perpendicular to the upper surface of the substrate 14. The evaporation is stopped when the thickness of the layer 23 is enough to seal the apertures 22. Thus, the cathodes (caesiated surfaces of the layers 17 or 19) are imprisoned in the microcavities.

Advantageously, the component may be annealed in situ in order to improve the mechanical properties of the layer 23.

Figure 8:
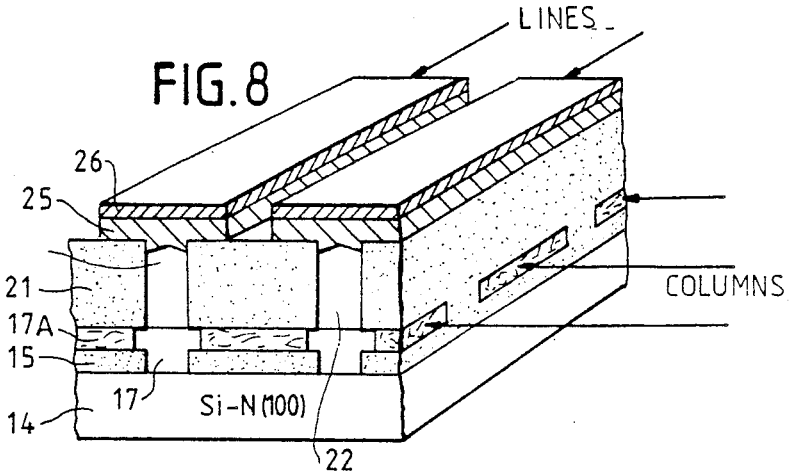

Step 7 (FIG. 8)

This step is implemented when it is sought to make a matrix display panel, namely a panel with a large number of cathodoluminescent display elements arranged in rows and columns. As these elements are very small-sized, several of them can be assembled to form a single light dot (called a "pixel"). In this case, the layers 17A are made in mutually parallel strips (see also FIG. 3A) to form, for example, the columns of the matrix device. The step 7 then consists in making mutually parallel strip of luminophor material by the etching of the layer 23 made during the step 6. These strips 25 of luminophor material are perpendicular to the strips 17A and form the rows of the matrix device for the above-mentioned example. It is clearly also possible to make a matrix device on the basis of the embodiment of FIG. 3B, in forming mutually parallel strips in the p type silicon layer (19, 20) and, then, in forming strips in the luminophor material in the same way as for the embodiment of FIG. 8. The device shown in FIG. 9 is then obtained.

In the embodiment of FIG. 8, so as to reduce the access resistance values of the strips of luminophor material, the upper surface of these strips 25 can be coated with a thin, transparent layer 26, made of a material which is a good conductor of electricity, advantageously indium tin oxide (ITO).

A pixel is obtained by applying, firstly, a voltage between a column and the substrate 14 and, secondly, a voltage between a row and the substrate 14. Naturally, as specified above, this pixel can be defined by several elementary cathodoluminescent devices: it is then enough for several of these elementary devices to be formed on the width of a row and/or a column. It is then possible to give this pixel any desired shape.

Figure 9:
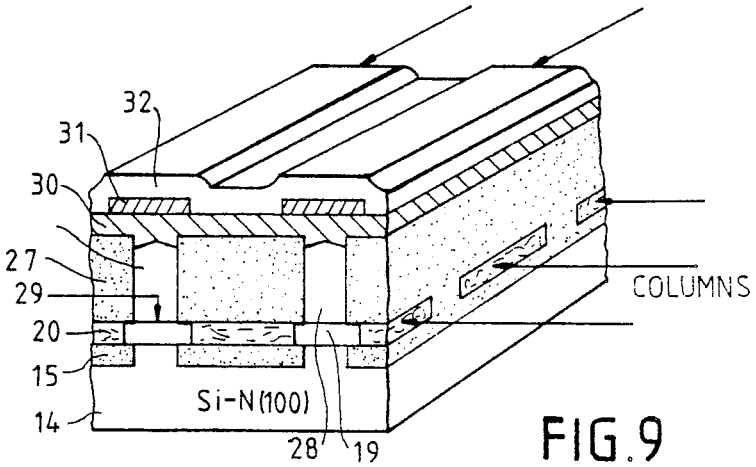

The matrix display device shown in FIG. 9 is made, after the step 2 (embodiment of FIG. 3B), according to the steps 3 to 6 described above for the embodiment of FIG. 3A. The result of these steps is the formation of the silica layer 27, in which cavities 28 are etched. The bared surfaces of monocrystalline p silicon, cleaned and caesiated, are referenced 29. The layer of luminophor material is referenced 30. The step 7, for this device of FIG. 9, also consists in forming strips of luminophors. As described above, these strips may be formed by the etching of the layer 30 of luminophor material. However, if this luminophor material is resistive enough, it is not necessary to etch the strips in order to isolate them from one another. The rows are then determined by the deposition of a thin, transparent layer, for example of indium tin oxide, in the form of strips 31, parallel to one another (and perpendicular to the columns).

Finally, on the device thus made, it is possible to deposit a layer 32 (covering at least its upper face) of translucid passivating material (for example, phosphosilicate glass) so as to isolate this device from external aggression. This layer 32 has been shown only for the embodiment of FIG. 8, but it is clear that it can also be deposited on the device of FIG. 8.

The component, for which the fabrication method has been described above, is a display device. However, the invention is not restricted to a component such as this. If the layer of luminophor material is replaced by a layer of material which is a good conductor of electricity, such as molybdenum, and if each anode is made to have a specific character, triode type microtubes are obtained. These microtubes can be used to make integrated circuits, with each microtube behaving like a bipolar transistor.

Advantageously, it is possible to deposit a layer of material which will produce a "getter" effect, sandwiched in the silica layer 21 or 27. The getter material may be, for example, one of the following elements: Ti, Ta, Zr, Ca. The silica layer is then deposited in two steps separated by a step for the deposition of this getter material. This is valid for display components as well as for microtubes.

What is claimed is:

1. A method for fabricating a component of the cold cathode type formed on a substrate made of a semiconducting material capable of being brought to a state of negative electron affinity, implemented for a silicon substrate, said method consisting in:

oxidizing one face of an at least partially monocrystalline, n type silicon substrate;

etching at least one aperture in the silica of this face;

depositing p type silicon on the silica and on the bared parts of the substrate so as to have a surface that is really plane after deposition, said silicon being monocrystalline in the apertures and polycrystalline on the silica;

depositing a layer of dielectric material;

etching, in this latter layer, apertures that are substantially in the axis of the above-mentioned apertures until the layer of p type silicon is reached;

performing an in situ cleaning of the bared surfaces of the p type silicon layer;

doing a treatment that brings the cleaned surfaces to a state of negative electron affinity;

evaporating a layer of anode material under high vacuum and at grazing incidence, with the substrate undergoing a rotational motion on an axis perpendicular to the surface of this substrate, until the sealing of the microcavity thus made.

2. A method according to claim 1, wherein the p type silicon layer is epitaxially grown by chemical vapor deposition.

3. A method according to claim 2, wherein the deposition is done by cracking of molecules of a gas mixture $SiH_4+H_2+B_2H_6$ at atmospheric pressure, at a temperature of about 900 to 1 060 degrees C.

4. A method according to claim 2, wherein the deposition is done by selective epitaxy, in using a gas mixture $SiH_4+HCl+H_2+B_2H_6$ at atmospheric pressure, or at reduced pressure, at a temperature of 900 degrees C to 1 060 degrees C approximately.

5. A method according to claim 4, wherein the apertures in the silica are filled, and the inlet of the HCl gas is cut off so as to obtain a uniform deposit.

6. A method according to claim 5, wherein the total thickness of the deposit of p type silicon is about one micrometer.

7. A method according to claim 2, wherein first of all the apertures made in the silica are filled with n type monocrystalline silicon, without depositing it on the silica, then the deposition of p type silicon is done.

8. A method according to claim 7, wherein the deposition of n type monocrystalline silicon is made by using a gas mixture $SiH_4+H_2+B_2H_6$.

9. A method according to claim 7, wherein the deposition of p type monocrystalline silicon is made by using a gas mixture $SiH_4+B_2H_6$.

10. A method according to claim 7, wherein the p type silicon layer has a thickness of 1 000 to 5 000 Å approximately.

11. A method according to claim 1, wherein the deposition of dielectric material is done at a temperature of 250 to 900 degrees C approximately.

12. A method according to claim 11, wherein wherein the dielectric material is silica, the deposition of silica being done by pyrolysis of $SiH_2Cl_2+N_2O$ at a temperature of 850 to 900 degrees C approximately.

13. A method according to claim 1, wherein the dielectric material is one of the following materials: $Si_3N_4$, $Al_2O_3$, $ZrO_2$.

14. A method according to claim 1, wherein the cleaning of the silicon surfaces bared during the making of the apertures in the dielectric material is done in a chamber under ultrahigh vacuum, at a temperature of about 1 000 degrees C.

15. A method according to claim 14, wherein the negative electron affinity of the bared and cleaned surfaces is obtained by caesiation under ultrahigh vacuum.

16. A method according to claim 1, implemented for a cathodoluminescent component, wherein the anode material is a luminophor material.

17. A method according to claim 16, wherein the luminophor material is zinc oxide.

18. A method according to claim 16, wherein an in situ annealing of the components is done, so as to improve the mechanical properties of the anode.

19. A method according to claim 16, to make a matrix display device, wherein the silicon p layer is formed in mutually parallel strips, and wherein strips that are mutually parallel and perpendicular to the p type silicon strips are etched in the layer of luminophor material.

20. A method according to claim 16, to make a matrix display device, wherein the silicon p layer is formed in mutually parallel strips, and wherein mutually parallel strips of a transparent, conductive material are deposited on the layer of resistive, luminophor material, these strips being perpendicular to the p type silicon strips.

21. A method according to claim 19, wherein a thin layer of transparent, conductive material is deposited on the strips of luminophor material.

22. A method according to claim 21, wherein the transparent, conductive material is indium tin oxide.

23. A method according to claim 1, wherein a translucid, passivating material is deposited on the component.

24. A method according to claim 23, wherein the translucid, passivating material is a phosphosilicate glass.

25. A method according to claim 1, wherein the deposition of the layer of dielectric material is done in two steps of deposition separated, each time, by a layer of material which will produce a getter effect.

* * * * *